United States Patent [19]

Sugita et al.

[11] Patent Number: 4,590,972

[45] Date of Patent: May 27, 1986

[54] WEFT INSERTING APPARATUS FOR JET LOOMS

[75] Inventors: Katsuhiko Sugita; Tsutomu Sainen, both of Kanazawa, Japan

[73] Assignee: Tsudakoma Corp., Kanazawa, Japan

[21] Appl. No.: 545,404

[22] Filed: Oct. 25, 1983

[30] Foreign Application Priority Data

| | | | |
|---|---|---|---|
| Oct. 28, 1982 | [JP] | Japan | 57-189570 |
| Oct. 28, 1982 | [JP] | Japan | 57-189571 |
| Nov. 22, 1982 | [JP] | Japan | 57-177682[U] |
| Dec. 8, 1982 | [JP] | Japan | 57-185442[U] |
| Sep. 28, 1983 | [JP] | Japan | 58-181646 |

[51] Int. Cl.[4] ..... D03D 47/30

[52] U.S. Cl. ..... 139/435

[58] Field of Search ..... 139/435

[56] References Cited

U.S. PATENT DOCUMENTS

| | | | |
|---|---|---|---|
| 3,828,829 | 8/1974 | Gotoh | 139/435 |
| 4,102,361 | 8/1985 | Tanaka | 139/435 |
| 4,178,971 | 12/1979 | Malasek | 139/435 |
| 4,187,888 | 2/1980 | Van Mullekom | 139/435 |
| 4,446,893 | 5/1984 | Gunneman | 139/435 |
| 4,458,726 | 7/1984 | Wenig | 139/435 |

FOREIGN PATENT DOCUMENTS 1596964 8/1985 United Kingdom .

*Primary Examiner*—Henry S. Jaudon
*Assistant Examiner*—Joseph S. Machuga
*Attorney, Agent, or Firm*—Flynn, Thiel, Boutell & Tanis

[57] ABSTRACT

A weft inserting apparatus in a jet loom comprises a nozzle for inserting a stored weft yarn through a shed on a jet of fluid, weft insertion control means such as a control valve for controlling the starting and ending of the insertion of the weft yarn through the shed, and a control unit for determining a delay time based on a rotating condition of the jet loom at least under a transient operating condition of the jet loom, and for controlling the weft insertion control means to allow the weft yarn to be inserted for a prescribed period upon elapse of the delay time after an angle for starting apparent weft insertion.

16 Claims, 21 Drawing Figures

CONTROL UNIT
CONTROL UNIT
CONTROL UNIT
CONTROL UNIT

WEFT INSERTING APPARATUS FOR JET LOOMS

FIELD OF THE INVENTION

The present invention relates to a weft inserting apparatus for jet looms, and more particularly to an apparatus for controlling a jet of weft carrying medium such as water or air, particularly air, to be ejected under transient operating conditions in substantially the same manner as in a normal operating condition.

BACKGROUND OF THE INVENTION

Principal motions in looms are all correlated to the angle of rotation of the prime mover which drives the loom. The timing with which main and auxiliary nozzles eject weft inserting jets is controlled generally by a mechanical cam. The cam is driven by the main shaft or spindle of the loom in synchronism with the operation of the loom.

The RPM of the rotating parts of the loom does not reach a normal RPM during transient operating conditions, such as when the loom is just started to operate. As a result, a jet of weft carrying fluid is ejected at the start of the loom for a longer interval of time than the time interval for which the jet is ejected under normal operating conditions notwithstanding that the ejection starts at a normal angle. This problem arises out of the fact that under such a transient condition, it takes a long period of time for the rotating parts to make one complete revolution and hence to move between certain angles. Therefore, the jet of fluid tends to be ejected at a greater rate than necessary during the initial period of operation of the loom. This sometimes causes the weft yarn as it is being inserted to be broken by the jet, and to be bent at its distal end due to any difference between the timings of operation of the main and auxiliary nozzles, resulting in unstable weft inserting operation.

To prevent the foregoing shortcomings, a jet loom disclosed in Japanese Patent Publication No. 57-38699 (corresponds to British Pat. No. 1,596,964) controls the flow rate of a weft inserting fluid in relation to the RPM of the loom so that the flow rate will proportionally be small at low RPMs. With the disclosed jet loom, however, the weft insertion remains still unstable as the weft yarn runs under different conditions at the start of the loom than those under which the weft yarn is inserted while the loom operates normally.

The weft yarn as inserted through a warp shed is detected by a weft feeler at the edge of the fabric being woven which is remote from the ejection nozzles. The loom has a control unit responsive to an output signal from the weft feeler for sequentially controlling the operation of the loom while monitoring the condition of weft insertion. Therefore, the time at which the weft yarn reaches the fabric edge remote from the nozzles serves to provide a critical timing for the control of the loom. If a jet of weft inserting fluid is ejected under the transient conditions for a prescribed period of time starting from the same angle as that in the normal condition, then the rate of flow of the fluid is equalized to that in the normal conditions, but the weft yarn reaches the edge of a fabric being woven remotely from the nozzles at a time faster than that in the normal condition. As a consequence, the loom cannot be properly controlled.

SUMMARY OF THE INVENTION

It is accordingly an object of the present invention to provide a weft inserting apparatus for jet looms which is capable of controlling the interval and flow rate of a weft inserting fluid to be ejected under transient operating conditions, especially when the loom starts operating, in substantially the same manner as in a normal operation condition, thereby stabilizing the weft inserting operation.

To achieve the above object, the rotating characteristics of the parts of the loom are taken into consideration, and main and auxiliary nozzles for weft insertion, or either one of them, are closed during a controlled interval of time for inserting a weft yarn under the transient operating condtions with the same ejection speed and flow rate of the fluid as those in the normal operating condition. The weft yarn can thus be inserted stably under the transient operating conditions in the same manner as in the normal operating condition.

Another object of the present invention is to provide a weft yarn inserting apparatus in jet looms which is capable of controlling weft yarns to reach the fabric edge remote from weft insertion nozzles under the transient operating conditions of the loom at the same timing as that during the normal operating condition of the loom.

The above object can be achieved by starting to eject the weft inserting fluid a predetermined delay time after a weft insertion starting angle during the transient operating conditions. Therefore, the angle at which the fluid ejection is finished remains the same in the transient and normal operating conditions, with the result that the loom can be controlled in the same manner under the transient and normal operating conditions. The delay time is determined in relation to the transient rotating characteristics of the loom. According to the present invention, the delay time can be determined by the following three principles:

According to the first principle, the delay time is calculated from the RPM of the loom. The interval of time in which the weft yarn is inserted through the warp shed is in inverse proportion to the number of revolutions per unit time of the loom. With the RPM of the loom immediately prior to weft insertion in a transient period being known, the delay time for the weft insertion can be derived from that RPM. A control system according to this principle can be designed basically with an arithmetic circuit.

According to the second principle, the delay time is set by a timer. Since the rising characteristics at the start of the loom remains substantially unchanged and the starting angle at the time of starting operation of the loom also remains constant, the delay time after which the weft yarn is to be inserted in a transient operating condition is also kept substantially constant. Therefore, the delay time can be determined experimentally, or derived from calculations based on this principle. A control system according to the second principle can be achieved by utilizing a time delay element such as a time constant circuit.

According to the third principle, the delay time is derived from an angle of rotation of the loom. Since the delay time can be determined in the transient period according to the second principle, the angle of rotation of the loom upon elapse of the delay time can also be known. A control system based on the third principle measures the angle upon elapse of the delay time, and provides weft inserting timing at the measured angle. A control system according to the third principle is basically composed of an angle measuring means and a memory circuit such as flip-flops.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
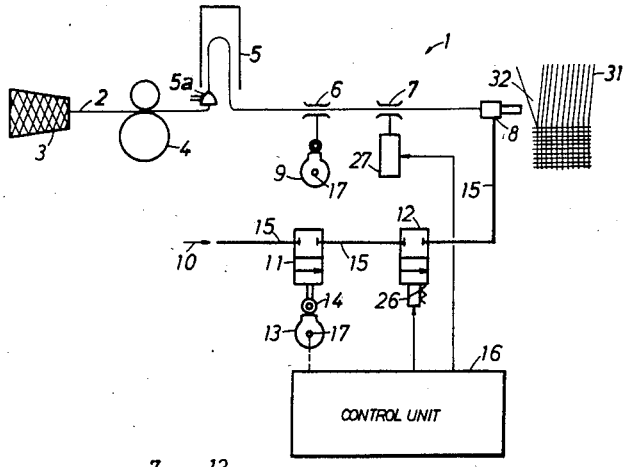
FIG. 1 is a schematic diagram showing a weft inserting apparatus for a jet loom according to a first embodiment of the present invention.

Embodiment 1 (FIGS. 1, 2 and 3):

FIG. 1 shows a weft inserting apparatus 1 in a jet loom according to a first embodiment. A weft yarn 2 is unreeled from a yarn supply 3 by a length measuring device 4 composed of rollers for a length required for a single weft inserting operation. The unreeled yarn length is stored through a storage nozzle 5*a* into a storage unit 5, and then led through weft control means comprising clamps 6, 7 to a main nozzle 8 for weft insertion. The clamp 6 is controlled by a cam 9 acutatable in synchronism with rotation of the prime mover in the jet loom. A weft inserting fluid 10 such as air or water is delivered to the main nozzle 8 through a supply passage 15 having two weft control means such as a mechanical ejection control valve 11 and a solenoid-operated control valve 12 openable when energized. The ejection control valve 11 is actuated by a cam 13 mounted on a shaft 17. The cam 13 is rotatable in synchronism with operation of the jet loom for actuating a cam follower 14 to open the ejection control valve 11 during an interval from an ejection starting angle $\theta_S$ (FIG. 3) to an ejection ending angle $\theta_E$. The fluid 10 reaches the main nozzle 8 through the supply passage 15 only when the ejection control valve 11 and the control valve 12 are opened to allow passage of the fluid 10 therethrough.

The control valve 12 is controlled by a control unit 16. The control unit 16 is responsive to the RPM of the jet loom under a transient operating condition thereof for deriving a necessary delay time $\Delta T$ from the ejection starting angle $\theta S$ based on the foregoing first principle. The control unit 16 then opens the control valve 12 for a prescribed interval of time T between an ejection starting timing $t_S$ corresponding to the delay time $\Delta T$ and an ejection ending timing $t_E$. While the jet loom is in its normal rotating condition, the control unit 16 controls the control valve 12 to be open at all times and enables only the ejection control valve 11 to control the fluid 10.

Figure 2:
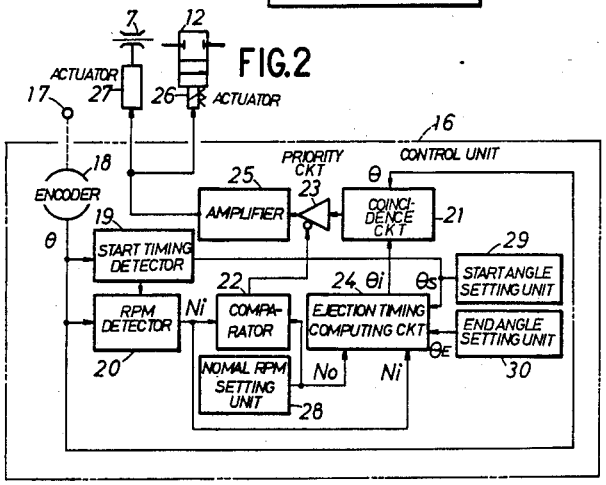
FIG. 2 is a block diagram of a control unit in the weft inserting apparatus shown in FIG. 1.

FIG. 2 illustrates the control unit 16 in detail. The control unit 16 includes an encoder 18 coupled to the shaft 17 of the cam 13. The encoder 18 is connected to a start timing detector 19, an RPM detector 20, and a coincidence circuit 21. The RPM detector 20 is connected to a comparator 22 coupled to a priority circuit 23 and also is connected to an ejecting timing computing circuit 24 coupled to the coincidence circuit 21. The coincidence circuit 21 has an output terminal connected to the priority circuit 23, which is connected to an amplifier 25 coupled to a solenoid-operated actuator 26 for the control valve 12 and an actuator 27 such as a solenoid-operated plunger for the clamp 7. A normal RPM setting unit 28 is connected to the comparator 22 and the ejection timing computing circuit 24. To the ejection timing computing circuit 24, there are connected a start angle setting unit 29 and an end angle setting unit 30. The start angle setting unit 29 is connected to the start timing detector 19 which is joined to the RPM detector 20.

Figure 3:
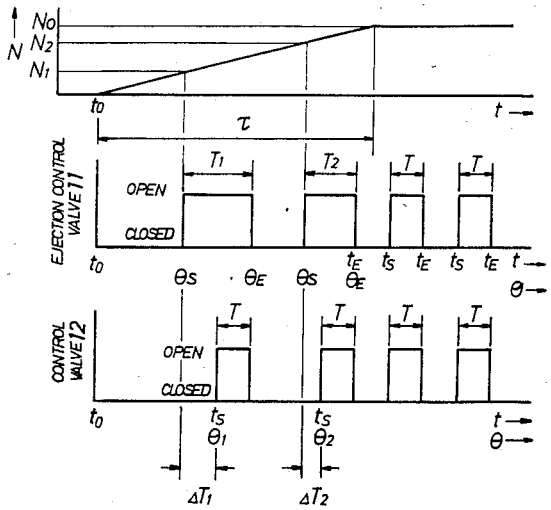
FIG. 3 is a timing chart illustrative of operation of the weft inserting apparatus of FIG. 1.

Operation of the weft inserting apparatus 1 will be described with reference to FIG. 3. FIG. 3 shows the RPM N of the prime mover of the jet loom, and the switching operations of the ejection control valve 11 and the control valve 12 with respect to time t or angle $\theta$ of rotation from the starting of the jet loom to a normal operating condition thereof. The RPM N of the loom reaches a normal RPM $N_0$ upon elapse of a transient time $\tau$ after a starting time $t_0$. FIG. 3 illustrates two weft inserting operations effected in the transient time $\tau$. While the RPM N is low, the RPM of the cams 9, 13 is low, and hence the ejection control valve 11 and the clamp 6 are open in transient ejection periods $T_1$, $T_2$ longer than a normal ejection period T in inverse proportion to the transient low RPM N. More specifically, the prescribed ejection period T under the normal operating condition remains constant from the ejection starting timing $t_S$ and the ejection ending timing $t_E$, but the ejection periods $T_1$, $T_2$ in the transient time are a function of the transient RPM N and thus are variable. The ejection periods $T_1$, $T_2$ can be expressed by using the prescribed ejection period T and delay times $\Delta T_1$, $\Delta T_2$ as follows:

$$T_1 = T + \Delta T_1$$

$$T_2 = T + \Delta T_2$$

With the ejection starting timing $t_S$ and the ejection ending timing $t_E$ corresponding respectively to the angles $\theta_S$, $\theta_E$, the prescribed ejection period T under the normal condition can be given by the following equation:

$$\frac{\theta_E - \theta_S}{360} = \frac{T}{60/N_0} \therefore T = \frac{\theta_E - \theta_S}{60N_0} \text{ [sec]}$$

The delay time $\Delta Ti$ (i=1, 2) and the angle $\theta i$ (i=1, 2) during the transient operation or at the starting of the jet loom can be derived from the above equation as follows (transient RPM during the transient operation being expressed as Ni):

$$T + \Delta Ti = \frac{\theta_E - \theta_S}{6Ni} \therefore \Delta Ti = \frac{\theta_E - \theta_S}{6}\left(\frac{1}{Ni} - \frac{1}{N_0}\right)$$

$$\theta i = 6Ni \cdot \Delta Ti + \theta_S$$

$$= (\theta_E - \theta_S)\left(1 - \frac{Ni}{N_0}\right) + \theta_S$$

Since the ejection starting timing $t_S$ and the ejection ending timing $t_E$, that is, the angles $\theta_S$, $\theta_E$, and the normal RPM $N_0$ are of predetermined values, the delay time $\Delta Ti$ can be calculated by finding the transient RPM Ni under the transient condition.

The ejection control valve 11 and the clamp 6 operate in synchronism with the rotation of the jet loom to enter a normal operation after the two transient ejection periods $T_1$, $T_2$, in which they are cyclically opened in the normal ejection periods T to release the wefay yarn 2 and eject the fluid 10 through the nozzle 8 for inserting the weft yarn 2 into a shed 32 of warp yarns 31.

The encoder 18 detects the angle $\theta$ of rotation and generates a signal indicative of this angle each time the loom makes one revolution. The start timing detector 19 detects coincidence between a signal representing the angle $\theta$ and a signal indicating the angle $\theta_S$ from the start angle setting unit 29, and activates the RPM detector 20 upon coincidence of these supplied signals. The RPM detector 20 then generates a signal indicative of the RPM Ni under the transient condition based on the signal of the angle $\theta$ from the encoder 18. Then, the ejection timing computing circuit 24 is supplied with the angles $\theta_S$, $\theta_E$ corresponding to the ejection starting and ending timings $t_S$, $t_E$, respectively, the signal of the transient RPM Ni, and the signal of the normal RPM $N_0$ which are determined by the foregoing equations, and issues a signal indicative of the angle $\theta i$ corresponding to the delay time $\Delta Ti$ to the coincidence circuit 21. The coincidence circuit 21 compares the signal of the angle $\theta$ of rotation of the jet loom with the signal of the angle $\theta i$, and delivers actuating outputs through the priority circuit 23 and the amplifier 25 to the actuators 26, 27 upon coincidence of the supplied signals. Before the actuating output is applied, the control valve 12 remains closed, and thus the fluid 10 is not supplied to the main nozzle 8 during the delay times $\Delta T_1$, $\Delta T_2$ notwithstanding that the ejection control valve 11 is open. At the time the angle $\theta i$ corresponding to the delay time $\Delta Ti$ is reached, the control valve 12 is opened by operation of the actuator 26, whereupon the fluid 10 starts being ejected from the main nozzle 8 substantially under the control of the control valve 12. The fluid 10 is then stopped at the ejection ending timing $t_E$ or the angle $\theta_E$ controlled by the ejection control valve 11. Therefore, the ejection periods $(T_1 - \Delta T_1)$, $(T_2 - \Delta T_2)$ under the transient condition are substantially the same as the ejection periods under the normal condition, and the flow rate of the fluid ejected under the transient condition remains the same as that under the normal condition. The foregoing operation holds true for the clamp 7. Since the angle $\theta i$ at the ejection ending timing $t_E$ is constant at all times in the weft inserting operation, the time at which the weft yarn 2 reaches the fabric edge remote from the nozzle 8 is also constant at all times in the normal and transient operating conditions.

When the transient RPM Ni of the jet loom reaches the normal RPM $N_0$ upon elapse of the transient time $\iota$, the comparator 22 detects the normal RPM and issues an output signal through the priority circuit 23 and the amplifier 25 to the actuators 26, 27. Therefore, after the jet loom has entered the normal operating condition, the control valve 12 and the clamp 7 are rendered continuously open and substantially inoperative. The weft insertion during the normal operating condition is performed only by the clamp 6 and the ejection control valve 11.

Figure 4:
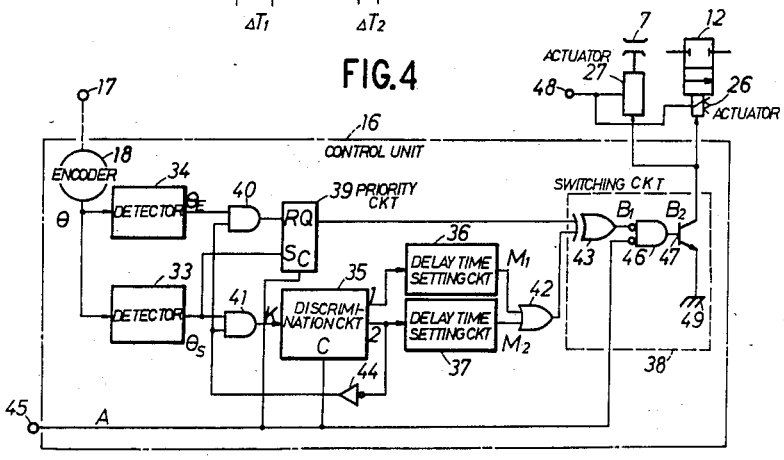
FIG. 4 is a block diagram of a control unit in a weft inserting apparatus according to a second embodimemt.

Embodiment 2 (FIGS. 4 and 5):

FIG. 4 is illustrative of a block diagram of a control unit 16 based on the foregoing second principle. The control unit 16 comprises an encoder 18 operable by a cam 13 (FIG. 1), detectors 33, 34 for detecting angles $\theta_S$, $\theta_E$ of rotation corresponding respectively to ejection starting and ending timings $t_S$, $t_E$, a discrimination circuit 35 such as a counter, delay time setting circuits 36, 37 such as monostable multivibrators, a switching circuit 38, and a priority circuit 39 such for example as a flip-flop. The detectors 33, 34 are connected to input terminals of AND gates 40, 41, respectively, which have output terminals coupled respectively to a clock input terminal of the counter 35 and a reset input terminal of the RS flip-flop 39. The counter 35 has output terminals "1", "2" connected respectively to the delay time setting circuits 36, 37, which have output terminals coupled through an OR gate 42 to an input terminal of an exclusive-OR gate 43 in the switching circuit 38. The output terminal "2" of the counter 35 is also connected to the other input terminals of the AND gates 40, 41. The flip-flop 39 has an output terminal connected to the other input terminal of the exclusive-OR gate 43. An input terminal 45 receptive of a stop signal A is connected to clear terminals of the counter 35 and the flip-flop 39, and to an input terminal of a NOR gate 46 in the switching circuit 38. The other input terminal of the NOR gate 46 is connected to the output terminal of the exclusive-OR gate 43. The NOR gate 46 has an output terminal coupled to the controlling terminal or base of a switching element 47 such as a transistor in the switching circuit 38. The transistor 47 and solenoid-operated actuators 26, 27 for a control valve 12 and a clamp 7 (FIG. 1) are connected in series between a power supply terminal 48 and ground 49.

Figure 5:
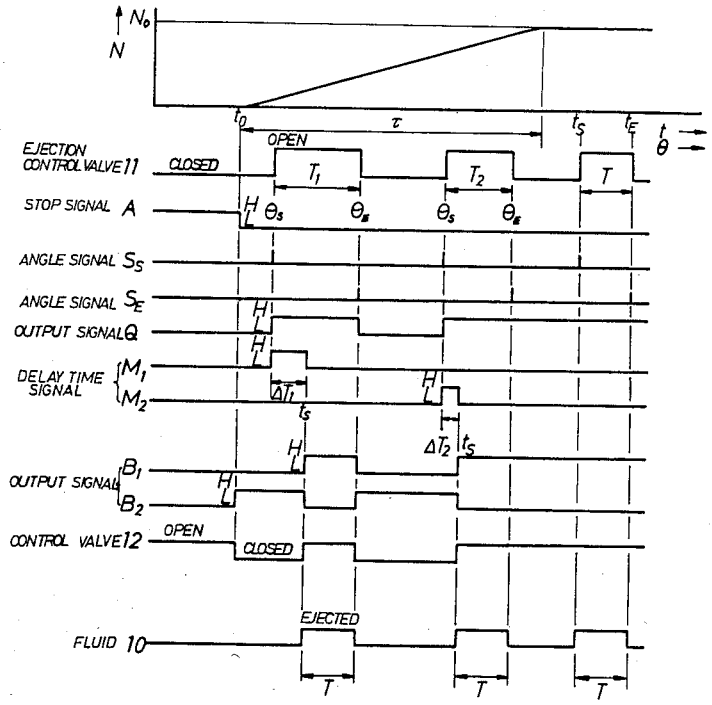
FIG. 5 is a timing chart illustrative of operation of the weft inserting apparatus of the second embodiment.

Operation of the control unit 16 shown in FIG. 4 will be described with reference to FIG. 5. FIG. 5 illustrates the RPM N of the jet loom, the switching operation of the ejection control valve 11 and the control valve 12, the stop signal A, angle signals $S_S$, $S_E$, delay time signals $M_1$, $M_2$, output signals Q, $B_1$, $B_2$, and the ejection of a fluid 10, all with respect to time t or angle $\theta$ of rotation from the starting of the jet loom to a normal operating condition thereof.

While the jet loom is in an inoperative condition, the stop signal A applied to the input terminal 45 is of a "H" level and initializes the counter 35 and the flip-flop 39. When the jet loom starts operating at a starting time $t_0$, the stop signal A varies from the "H" level to a "L" level. Since both input signals applied to the NOR gate 46 are of an "L" level at this time, the NOR gate 46 issues an output signal $B_2$ of a "H" level to turn on the transistor 32, thereby energizing the solenoid-operated actuators 26, 27 to close the clamp 7 and the control valve 12. When the signal indicative of the angle $\theta$ from the encoder 18 reaches a level indicative of an angle $\theta_S$ for starting apparent ejection, the detector 33 applies an angle signal $S_S$ to the set input terminal of the flip-flop 39 to change its output signal Q to a "H" level signal, and at the same time applies the angle signal $S_S$ to one of the input terminals of the AND gate 41. Since a signal of a "H" level is applied to the other input terminal of the AND gate 41, it issues the angle signal $S_S$ to the clock input terminal of the counter 35, whereupon the later counts "1" corresponding to a first weft inserting operation. The output from the counter 35 then actuates the delay time setting circuit 36 to enable the latter to generate a delay time signal $M_1$ of a "H" level, which is delivered through the OR gate 42 to the exclusive-OR gate 43 in the switching circuit 38. The delay time signal $M_1$ a pulse duration equal to the delay time $\Delta T_1$. With signals of an "H" level applied to both of the input terminals of the exclusive-OR gate 43, the latter generates an output signal $B_1$ of an "L" level to allow the NOR gate 46 to keep producing the "H" level signal. Therefore, the control valve 12 remains closed. Upon elapse of the delay time $\Delta T_1$, the delay time signal $M_1$ varies from the "H" level to the "L" level, when the output signal $B_1$ from the exclusive-OR gate 43 goes high, and the output signal $B_2$ from the NOR gate 46 goes low. The switching transistor 47 is now turned off to thereby open the control valve 12. Then, a first ejection ending angle $\theta_E$ is reached, and the detector 34 generates an angle signal $S_E$ of a "H" level that is delivered through the AND gate 40 to the reset input terminal of the flip-flop 39. The output signal Q of the flip-flop 39 now goes low. Accordingly, the output signal $B_1$ from the exclusive-OR gate 43 goes low, and the output signal $B_2$ from the NOR gate 46 goes high. The switching transistor 47 is then energized to immediately close the control valve 12. As described above, the ejection control valve 11 has already been opened at the angle $\theta_S$ for starting apparent ejection in the transient period $\tau$. Since the control valve 12 is only opened upon elapse of the delay time $\Delta T_1$, the fluid 10 is ejected only during a normal ejection period T from the ejection starting timing $t_S$ up to the ejection ending timing $t_E$ as in the normal operating condition of the jet lom.

When a second angle signal $S_S$ is applied, the flip-flop 39 is set again, and the counter 35 counts "2" to energize the second delay time setting circuit 37. The delay time setting circuit 37 issues a "H" level delay time signal $M_2$ having a pulse duration corresponding to a delay time $\Delta T_2$ through the OR gate 42 to the exclusive-OR gate 43. Since the control valve 12 is opened upon elapse of the delay time $\Delta T_2$ as in the first weft inserting operation, the fluid 10 is ejected during the normal ejection period T substantially beginning upon elapse of the delay time $\Delta T_2$.

After two jets of fluid have been ejected during the transient time $\tau$, the jet loom enters the normal operating condition and requires no subsequent control for weft insertion. The output "2" from the counter 35 is applied as a "L" level signal through the NOT gate 44 to the AND gates 40, 41, inhibiting the angle signals $S_S$, $S_E$. The output signal Q from the flip-flop 39 then remains high, and thus the output signals $B_1$, $B_2$ from the exclusive-OR gate 43 and the NOR gate 46 remain high and low, respectively. The transistor 47 is kept de-energized, and the control valve 12 remains open. During the normal operating condition, therefore, the ejection of the fluid 10 is controlled only by the switching operation of the ejection control valve 11.

According to the second embodiment as described above, the counter 35 can count up to "2" and the two delay time setting circuits 36, 37 are included on the assumption that there are two cycles of weft inserting operation effected during the transient period $\tau$ from the starting to the normal operation of the jet loom. The counter 35 may be arranged to count up to "1", "3" or more and a corresponding number of delay time setting circuits may be provided to meet the required number of weft inserting cycles in the transient period. The logic circuit arrangement in the control circuit 16 is shown by way of example, and other logic circuit arrangements may be employed to achieve the desired result.

Figure 6:
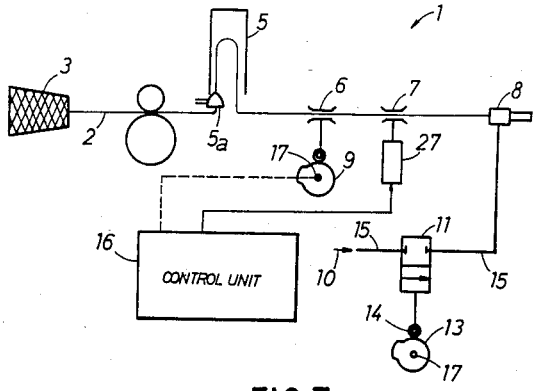
FIG. 6 is a schematic diagram showing a weft inserting apparatus according to a third embodiment.

Embodiment 3 (FIGS. 6 and 7):

The control unit 16 according to each of the Embodiments 1 and 2 controls the two weft insertion control means, the clamp 7 and the control valve 2, simultaneously. According to the Embodiment 3, however, the fluid 10 is not controlled, but only the weft yarn 2 is controlled in the transient period $\tau$. As shown in FIG. 6, only the ejection control valve 11 is disposed in the supply passage 15.

Even when the control valve 12 is opened early with no delay time $\Delta T$ under the transient condition, the weft yarn 2 as it is stored is released by the clamp 7 only after the delay time $\Delta Ti$. Therefore, the weft yarn 2 is inserted substantially after the delay time $\Delta Ti$. Such control is effective with strong weft yarns 2 suffering from no breakage while being inserted.

Figure 7:
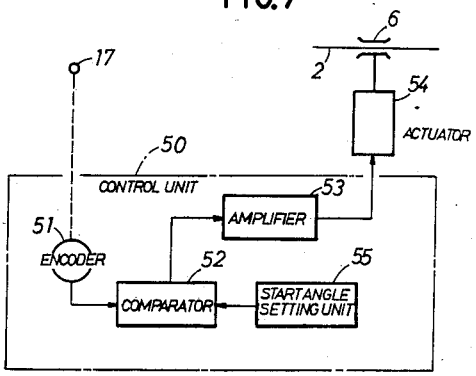
FIG. 7 is a block diagram of a control unit in the weft inserting apparatus shown in FIG. 6.

While in the Embodiments 1 and 2 the clamp 6 is driven by the mechanical means or the cam 9, the clamp 6 shown can be controlled by an electric control unit 50 illustrated in FIG. 7. The control unit 50 is composed of an encoder 51 operatively coupled to a main shaft 17 of a jet loom, a comparator 52 connected to the encoder 51, an amplifier 53 connected to the comparator 52 and a nonmechanical or solenoid-operated actuator 54 for actuating the clamp 6, and a start angle setting unit 55 connected to the comparator 52.

The encoder 51 applies an output signal indicative of an angle $\theta$ of rotation of the loom to one input terminal of the comparator 52. The start angle setting unit 55 applies a signal indicative of an angle $\theta_S$ corresponding to a start timing $t_S$ to the other input terminal of the comparator 52. The comparator 52 issues an output signal through the amplifier 53 to the actuator 54 when the output signal from the encoder 51 agrees with the output from the start angle setting unit 55, that is, when the angle $\theta$ of rotation of the loom coincides with the angle $\theta_S$ of rotation. The actuator 54 then controls the clamp 6 to grip or release the weft yarn 2 in the same manner in which the cam 9 controls the clamp 6.

Figure 8:
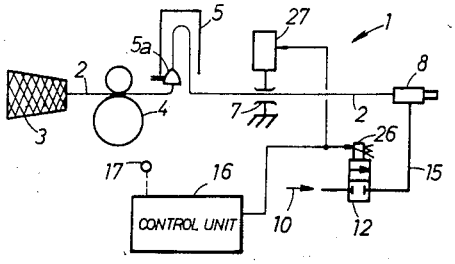
FIG. 8 is a schematic diagram showing a weft inserting apparatus according to a fourth embodiment.

Embodiment 4 (FIGS. 8, 9 and 10):

According to this embodiment, a weft inserting means is composed of a single clamp 7 and a single control valve 12 as shown in FIG. 8, and there are no mechanical clamp 6 and no ejection control valve 11. The clamp 7 and the control valve 12 serve to control the weft insertion continuously during the transient time $\tau$ as well as under the normal operating condition.

Figure 9:
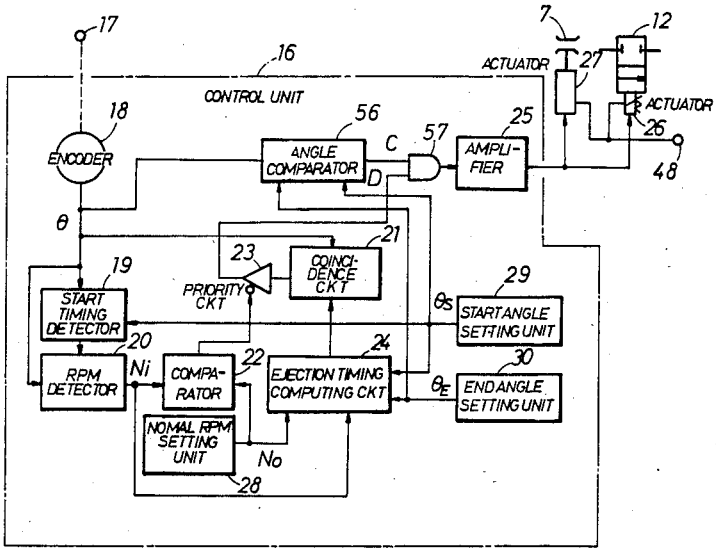
FIG. 9 is a block diagram of a control unit in the weft inserting apparatus shown in FIG. 8.

FIG. 9 shows a control unit 16 employed according to the Embodiment 4. The control unit 16 is basically the same in circuit arrangement as the control unit shown in FIG. 2, except for an angle comparator 56 and an AND gate 57 for effecting continuous weft insertion under the normal operating condition. The angle comparator 56 has input terminals connected to the encoder 18, the start angle setting unit 29, and the end angle setting unit 30, and an output terminal connected to one input terminal of the AND gate 57. The other input terminal of the AND gate 57 is coupled to the output terminal of the priority circuit 23. The AND gate 57 has an output terminal connected through the amplifier 25 to the solenoid-operated actuators 26, 27.

Figure 10:
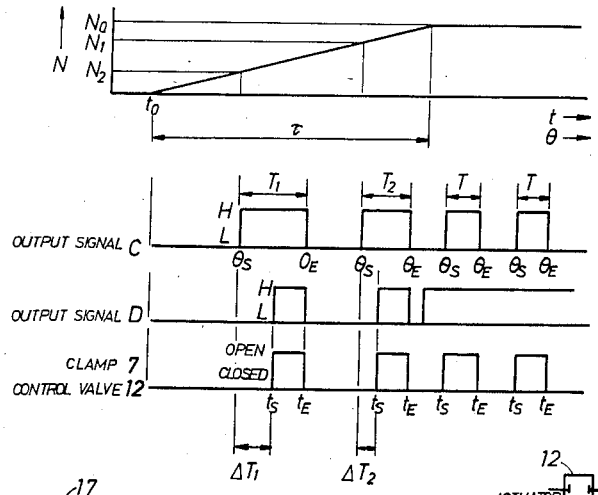
FIG. 10 is a timing chart illustrative of operation of the weft inserting apparatus of FIG. 8.

Operation of the weft inserting apparatus of FIGS. 8 and 9 will be described with reference to FIG. 10. The encoder 18 detects rotation of the jet loom and applies an output signal representative of an angle $\theta$ of rotation to one of the input terminals of the angle comparator 56. The start angle setting unit 29 and the end angle setting unit 30 apply signals of angles $\theta_S$, $\theta_E$ to the other input terminals of the comparator 56. When the condition: the start angle $\theta_S \leqq$ the output signal 18 $\leqq$ the end angle $\theta_E$ is met, the angle comparator 56 issues an output signal C of a "H" level to one of the input terminals of the AND gate 57.

If the "H" level output signal C were employed as drive signals for the actuators 26, 27, the clamp 6 and the control valve 12 would be open during longer time intervals $T_1$, $T_2$ than a normal time interval T during the transient time $\tau$ in inverse proportion to a transient low RPM N of the loom.

The encoder 18 detects an angle $\theta$ each time the main shaft of the loom makes one revolution and issues a signal indicative of the angle $\theta$ to the start timing detector 19. The start timing detector 19 detects coincidence between the signal representative of the angle $\theta$ and a signal indicative of an angle $\theta_S$ from the start angle setting unit 29, and actuates the RPM detector 20 upon such coincidence. The RPM detector 20 generates a signal indicative of the RPM Ni in the transient operating condition based on the signal of the angle $\theta$ from the encoder 18. The ejection timing computing circuit 24 is supplied with angles $\theta_S$, $\theta_E$ corresponding respectively to an ejection starting timing $t_S$ and an ejection ending timing $t_E$, a signal representing the transient RPM Ni, and a signal representing the normal RPM $N_0$, which are determined from the above-mentioned equations, and issues a signal of an angle $\theta_i$ corresponding to a delay time $\Delta Ti$ to the coincidence circuit 21. The coincidence circuit 21 then compares the signal representative of the angle $\theta$ of the loom and the signal representative of the angle $\theta i$, and applies an output signal D of a "H" level through the priority circuit 23 to the other input terminal of the AND gate 57 when the signals fed to the coincidence circuit 21 coincide with each other. The AND gate 57 produces a drive signal of a "H" level while both of the input signals are of a "H" level. The drive signal is delivered from the AND gate 57 through the amplifier 25 to the actuators 26, 27 for the clamp 6 and the control valve 12, respectively. The weft yarn 2 starts being inserted at ejection timings $t_S$ which are the delay times $\Delta T_1$, $\Delta T_2$ after the time of the angle $\theta_S$. The weft yarn 2 is released and the fluid 10 is no longer ejected at the time of the angle $\theta_E$ corresponding to the normal end timing $t_E$. Accordingly, the intervals $(T_1-\Delta T_1)$, $(T_2-\Delta T_2)$ of insertion of the weft yarn 2 under the transient condition are substantially the same as the normal insertion period T.

When the RPM N of the loom reaches the normal RPM $N_0$, the comparator 22 detects the normal RPM $N_0$, and renders the output from the priority circuit 23 high at all times from that time on. After the loom has entered the normal operating condition, therefore, the actuators 26, 27 are controlled substantially by the output signal C.

Embodiment 5 (FIGS. 11 and 12):

A control unit 16 according to the Embodiment 5 is employed for controlling the weft inserting apparatus according to the Embodiment 4 shown in FIG. 8. The circuitry of the control unit 16 is substantially the same as that of the control unit of the Embodiment 2 illustrated in FIG. 4. However, the control unit 16 of FIG. 11 additionally includes an angle comparator 56, a start angle setting unit 29, an end angle setting unit 30, a NOT gate 58, and a switching transistor 59.

The angle comparator 56 has an output terminal connected through the NOT gate 58 to the base of the transistor 59 which is connected parallel to the other transistor 47. The actuators 26, 27 according to the Embodiment 5 close the clamp 6 and the control valve 12 when energized.

Figure 11:
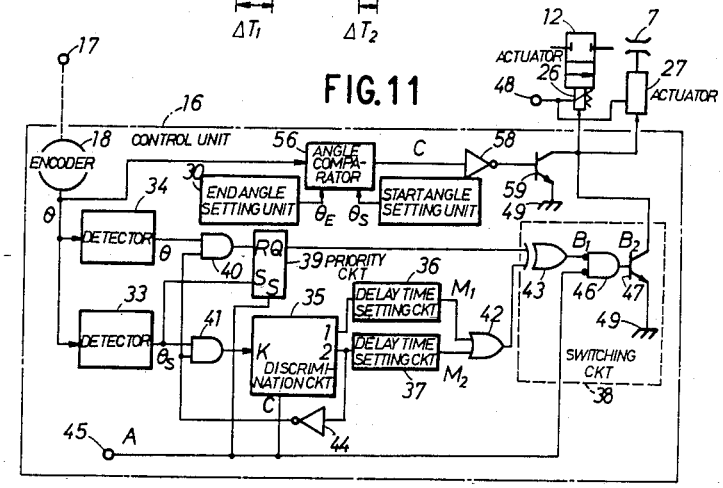
FIG. 11 is a block diagram of a control unit according to a fifth embodimemt.
Figure 12:
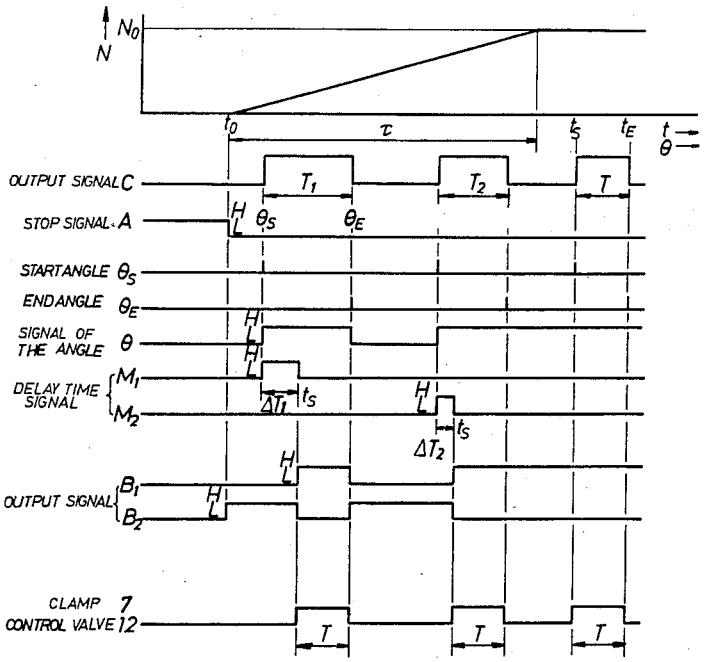
FIG. 12 is a timing chart illustrative of operation of the control unit of the fifth embodiment.

Operation of the control unit 16 shown in FIG. 11 will be described with reference to FIG. 12. The angle comparator 56 generates an output signal C as in the Embodiment 4. The output signal C is inverted by the NOT gate 58 before reaching the base of the transistor 59. When the output signal C is of a "H" level, the transistor 59 is turned off, causing the actuators 26, 27 to open the clamp 6 and the control valve 12 for weft insertion during time intervals $T_1$, $T_2$ longer than a normal opening time interval T. With an output signal $B_2$ being of a "H" level during delay times $\Delta T_1$, $\Delta T_2$, as described in the embodiment of FIG. 4, the actuators 26, 27 close the clamp 6 and the control valve 12 during the delay times $\Delta T_1$, $\Delta T_2$. Under the normal operating condition, the actuators 26, 27 are controlled directly by the output signal C from the angle comparator 56.

Figure 13:
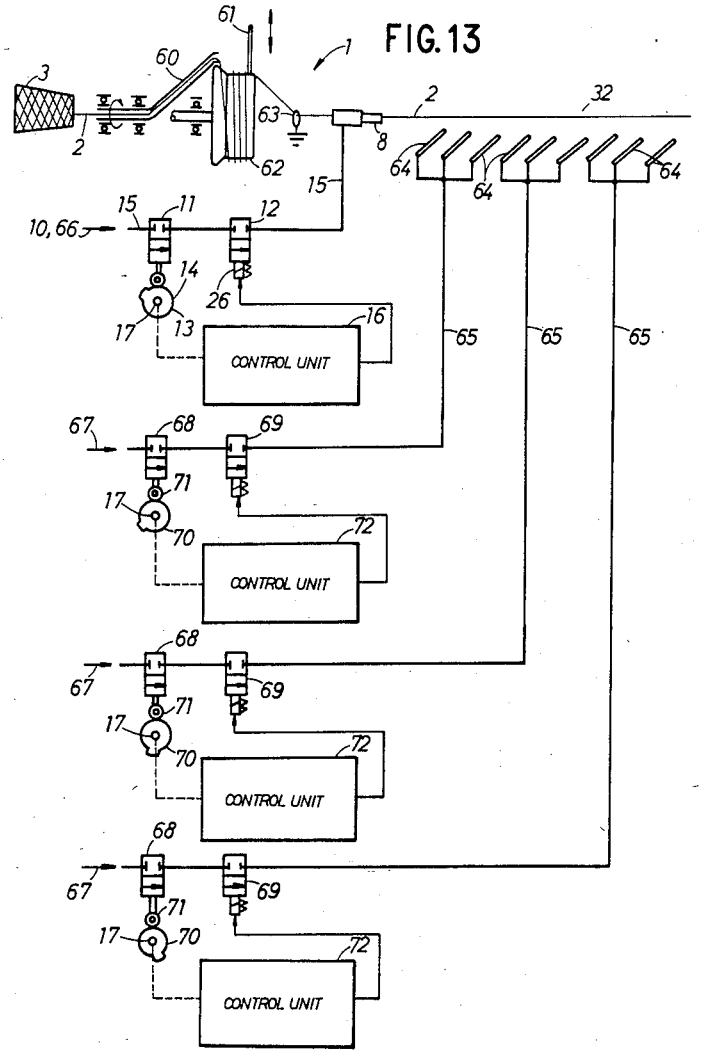
FIG. 13 is a schematic diagram of a weft inserting apparatus according to a sixth embodiment.

Embodiment 6 (FIGS. 13 through 16):

FIG. 13 shows a weft inserting apparatus 1 with a yarn storage drum according to the Embodiment 6. A weft yarn 2 as unwound from a yarn supply 3 passes through a winding arm 60 and is wound by a weft insertion control means comprising an engagement pin 61 as one pick or successive picks around a length measuring storage drum 62. The weft yarn 2 is then led through a yarn guide 63 to a weft inserting main nozzle 8. The winding arm 60 is rotatable around the drum 62, which is at rest, in synchronism with and by rotation of the jet loom. The drum 62 is also rotatable in coaxial relation to the winding arm 60, but is held at rest while the weft yarn 2 is being wound therearound. The engagement pin 61 is movable back and forth with respect to the drum 62. When the engagement pin 61 projects into an outer peripheral surface of the drum 62, it engages the weft yarn 2 on the drum to start winding of the weft yarn 2 thereon, that is, to prevent the weft yarn 2 from being unwound therefrom. When the engagement pin 61 is retracted, the weft yarn 2 as it is stored around the drum 62 can be unwound from the drum 62 for insertion through the main nozzle 8.

The main nozzle 8 ejects a weft inserting fluid 10 such as air 66 under pressure toward a shed 32 to carry the unwound weft yarn 2 through the shed 32. The air 66 under pressure is supplied through a supply passage 15 under the control of a mechanical ejection control valve 11 and a solenoid-operated control valve 12. The ejection control valve 11 is actuated by a cam 13 mounted on a shaft 17 rotatable in synchronism with rotation of the jet loom for causing the cam 13 to actuate a cam follower 14 during an internal from an ejection starting angle $\theta_S$ to an ejection ending angle $\theta_E$ for opening the ejection control valve 11. The air 66 under pressure therefore passes through the supply passage 15 to the main nozzle 8 when both the ejection control valve 11 and the control valve 12 are open to allow passage of the yarn 2 therethrough.

The control valve 12 is opened when it is energized and closed when it is de-energized under the control of a control unit 16.

The weft yarn 2 while it is being inserted is accelerated and driven by a plurality of auxiliary nozzles 64 disposed adjacent to the shed 32. The auxiliary nozzles 64 are divided into three groups which are each supplied with air 67 under pressure, the air 67 being less pressurized than the air 66. The auxiliary nozzles 64 eject the air 67 under pressure supplied through supply passages 65 toward the shed 32 to accelerate the air ejected from the main nozzle 8 along the shed 32 when the weft yarn 2 passes through the shed 32. Each of the supply passages 65 has a mechanical ejection control valve 68 and a solenoid-operated control valve 69 which is opened when energized and closed when de-energized. Each ejection control valve 68 is controlled by a cam 70 and a cam follower 71. The cams 70 are mounted on respective shafts 17 at different relative angles corresponding to the groups of auxiliary nozzles 64 that are positioned successively alongside of the shed 32. The control valves 69 are controlled by control units 72, respectively.

Figure 14:
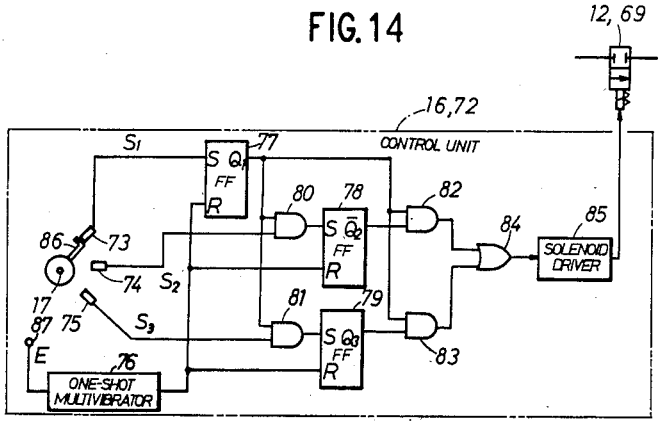
FIG. 14 is a block diagram of each control unit in the weft inserting apparatus shown in FIG. 13.

FIG. 14 illustrates the control unit 16 in detail. The control unit 16 is constructed on the basis of the third principle mentioned above, and comprises proximity switches 73, 74, 75, a one-shot multivibrator 76, RS flip-flops 77, 78, 79 serving as memory means, AND gates 80, 81, 82, 83, an OR gate 84, and a solenoid driver 85.

The proximity switches 73, 74, 75 serve as timing signal generating means and are located at different angular positions. A dog 86 mounted on the shaft 17 is angularly movable closely to the proximity switches 73, 74, 75. The proximity switch 73 is connected to a set input terminal of the flip-flop 77, while the proximity switches 74, 75 are connected to one input terminals of the AND gates 80, 81, respectively. The one-shot multivibrator 76 has an input terminal coupled to an input terminal 87 receptive of an operation signal E and an output terminal connected to reset input terminals of the flip-flops 77, 78, 79. The flip-flop 77 has an output terminal connected to the other input terminals of the AND gates 80, 81 and to input terminals of the AND gates 82, 83. The AND gates 80, 81 have output terminals coupled to set input terminals of the flip-flops 78, 79 with their output terminals connected to the other input terminals of the AND gates 82, 83. The AND gates 82, 83 have output terminals coupled to the input terminals of the OR gate 84 having an output terminal connected to the solenoid driver 85. The solenoid driver 85 is connected to an actuator 26 for actuating the control valve 12.

Each of the control units 72 for actuating the control valve 69 is of the same construction as that of the control unit 16.

Figure 15:
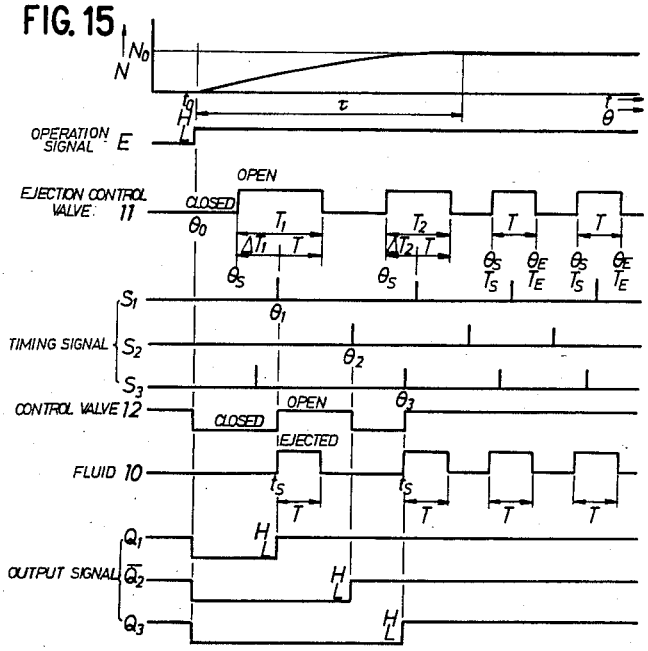
FIG. 15 is a timing chart showing operation of the weft inserting apparatus illustrated in FIG. 13.

Operation of the weft inserting apparatus 1 shown in FIGS. 13 and 14 will be described with reference to FIG. 15. When an operation signal E of a "H" level is applied to the control system of the jet loom at an operation starting time $t_0$, the RPM N of the jet loom progressively increases from zero to a normal RPM $N_0$ during elapse of a transient time $\tau$.

While the RPM N is lower than the normal RPM $N_0$ during the transient time $\tau$, the RPM of the shaft 17 and hence the cam 13 is also low, and the ejection control valve 11 is open during transient ejection periods $T_1$, $T_2$ longer than a normal prescribed ejection period T in inverse proportion to the transient low RPM N. During the normal operation of the jet loom, an ejection starting angle $\theta_S$ is equal at all times to an ejection starting timing $t_S$, and therefore, the ejection period T remains constant at all times. During the transient time $\tau$, however, the ejection starting angle $\theta_S$ is not equal to the ejection starting timing $t_S$, and the ejection periods $T_1$, $T_2$ are a function of the transient RPM N and not constant.

A starting angle $\theta_0$ at the time of starting operation of the jet loom is predetermined, and the rising characteristic of the RPM N of the loom during the transient time $\tau$ is considered to be substantially constant. Therefore, the angles upon completion of the delay times $\Delta T_1$, $\Delta T_2$ are also substantially constant. The proximity switches 73, 75 generate timing signals $S_1$, $S_3$, respectively, at angles $\theta_1$, $\theta_3$ corresponding to the times when the delay times $\Delta T_1$, $\Delta T_2$ elapse, and the proximity switch 74 generates a timing signal $S_2$ of a "H" level at an angle $\theta_2$ between the timing signals $S_1$, $S_3$.

Since the "H" level operation signal E is applied at the operating starting time $t_0$, the one-shot multivibrator 76 produces an output signal of a "H" level to reset the flip-flops 77, 78, 79 in advance. The AND gates 82, 83 produce output signals of an "L" level, and the solenoid driver 85 closes the control valve 12.

When the timing signal $S_1$ of a "H" level is applied to the set input terminal of the flip-flop 77 at the angle $\theta_1$ which is the delay time $T_1$ after the angle $\theta_S$ for starting apparent ejection, the flip-flop 77 generates an output signal $Q_1$ of a "H" level at the output terminal thereof. Since the input terminals of the AND gate 82 are supplied with "H" level signals, the AND gate 82 issues an output signal of a "H" level to energize the solenoid driver 85. The solenoid driver 85 thus opens the control valve 12 at the time of an angle $\theta$. Therefore, the control valve 12 is opened at a time which is the delay time $\Delta T_1$ after the angle $\theta_S$ for starting apparent ejection. As a result, the air 66 under pressure is ejected from the main nozzle 8 during the prescribed period T in which both the ejection control valve 11 and the control valve 12 are open. The unwound weft yarn 2 is now inserted through the shed 32 by the ejected air 66 under pressure. The ejection period T in the transient time $\tau$ is substantially the same as the ejection period T under the normal operating condition of the jet loom.

In the process of insertion of the weft yarn 2 through the shed 32, the auxiliary nozzles 64 successively eject the air 67 under pressure to additionally accelerate the weft yarn 2. The auxiliary nozzles 64 are also subjected to a certain delay time $\Delta T_1$ for their operation as described above. The auxiliary air 67 under pressure can successively and smoothly be ejected without interruption from the auxiliary nozzles 64 by opening the groups of auxiliary nozzles 64 during overlapped intervals. Consequently, the air 67 under pressure can be ejected toward the shed 32 from the auxiliary nozzles 64 at times optimum for the acceleration of the weft yarn 2. As described above, the cams 70 are mounted on the shaft 17 at different angular positions since the groups of auxiliary nozzles 64 are successively actuated to eject the air 67 in such a manner that the nozzle group closest to the main nozzle 8 is first opened. The auxiliary jets of air are not shifted on a time axis during the transient time $\tau$, so that the air flow through the shed 32 will be prevented from being disturbed.

After the first weft inserting cycle has been completed, the proximity switch 74 issues a timing signal $S_2$ of a "H" level to one of the input terminals of the AND gate 80, which produces an output signal of a "H" level to set the flip-flop 78, which applies an output signal $\overline{Q}_2$ of an "L" level to one of the input terminals of the AND gate 82. The output signal from the AND gate 82 now goes low to enable the solenoid driver 85 to close the control valve 12. If the timing signal $S_2$ is generated earlier than the ejection ending angle $\theta_E$, then the ejection ending time can be controlled.

When the second ejection starting angle $\theta_S$ is reached, the ejection control valve 11 is immediately opened. Since the control valve 12 is opened only after the delay time $\Delta T_2$ as in the first ejection cycle, the air 66 under pressure is ejected throughout the prescribed ejection period T. More specifically, when the proximity switch 75 generates a timing signal $S_3$ of a "H" level after the delay time $\Delta T_2$, the AND gate 81 produces a "H" level output signal to set the flip-flop 79 to render an output signal $Q_3$ thereof high. With "H" level input signals applied to the input terminals of the AND gate 83, the AND gate 83 issues an "H" level output signal through the OR gate 84 to the solenoid driver 85. The solenoid driver 85 then opens the control valve 12 upon elapse of the delay time $\Delta T_2$. The air 66 under pressure is ejected from the main nozzle 8 for weft insertion only during the period in which both the ejection control valve 11 and the control valve 12 are open. The above operation holds true for the auxiliary valves 64.

After two weft inserting cycles have been effected in the transient time $\tau$, the RPM N of the jet loom reaches the normal RPM $N_0$, and the above-mentioned control is no longer required. Therefore, the control unit 16 continuously opens the control valve 12 upon elapse of the transient time $\tau$. Under the normal operating condition of the jet loom, the air 66 under pressure is controlled substantially by the ejection control valve 11. More specifically, after the first two weft inserting cycles are over, all of the flip-flops 77, 78, 79 generate the "H" level output signals $Q_1$, $\overline{Q}_2$, $Q_3$ to apply the "H" level input signal continuously to the solenoid driver 85, which continuously keeps the control valve 12 open. The response speed of the control valve 12 is increased by temporarily applying a higher voltage from the solenoid driver 85 to the control valve 12 than the voltage necessary for actuating the control valve 12.

Figure 16:
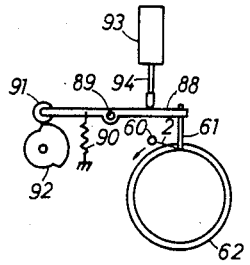
FIG. 16 is a front elevational view of an engagement pin drive mechanism in the weft inserting apparatus shown in FIG. 13.

A drive mechanism for the engagement pin 61 will be described with reference to FIG. 16. The engagement pin 61 is attached to a distal end of a swing lever 88 pivotally supported by a support shaft 89 and normally biased by a spring 90 to turn counterclockwise to bring a roller 91 on the other end of the swing lever 88 into contact with a driver cam 92. The driver cam 92 is in principle rotatable in one revolution in response to one revolution of the jet loom for lifting the engagement pin 61 off the peripheral surface of the drum 62 to allow the weft yarn 2 to be unwound. Even if the weft yarn 2 is unwound in the transient time $\tau$ in the same manner as that under the normal operating condition, the main nozzle 8 ejects the fluid after the delay times $\Delta T_1$, $\Delta T_2$ so that the weft yarn 2 will be inserted after the delay times $\Delta T_1$, $\Delta T_2$.

Any unstable condition of the weft yarn 2 as it is stored on the drum 62 is avoided by a solenoid-operated plunger 93. The solenoid-operated plunger 93 actuates a plunger rod 94 into abutment against the swing lever 88 during the delay times $\Delta T_1$, $\Delta T_2$ in the transient time $\tau$, and lifts the engagement pin 61 only upon elapse of the delay times $\Delta T_1$, $\Delta T_2$ to delay the unwinding of the weft yarn 2 to the normal starting timing $t_S$. The output from the control unit 16 can be employed to actuate the solenoid-operated plunger 93. Once the jet loom enters the normal operating condition, the solenoid-operated plunger 93 keeps the plunger rod 94 retracted at all times under magnetic forces and hence is not involved in the control of the movement of the engagement pin 61.

Figure 17:
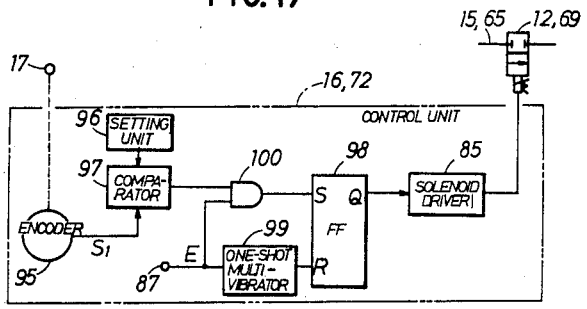
FIG. 17 is a block diagram of a control unit according to a seventh embodiment.

Embodiment 7 (FIGS. 17 and 18):

FIG. 17 shows a control unit 16, 72 according to a seventh embodiment. While the control unit 16, 72 shown in FIG. 14 controls the control valve 12, 69 for two weft inserting cycles in the transient time $\tau$, the control unit illustrated in FIG. 17 controls the control valve 12, 69 for one weft inserting cycle in the transient time.

A timing signal $S_1$ is produced by a timing signal generating means composed of an encoder 95 coupled to a shaft 17 and a comparator 97 which compares an output signal from the encoder 95 and an input signal from a setting unit 96, and is applied to one terminal of an AND gate 100. An operation signal E from an input terminal 87 is fed to the other input terminal of the AND gate 100 and to an input terminal of a one-shot multivibrator 99. The AND gate 100 and the one-shot multivibrator 99 are connected to set and reset input terminals of a flip-flop 98 serving as a memory circuit and having an output terminal coupled directly to a solenoid driver 85.

Figure 18:
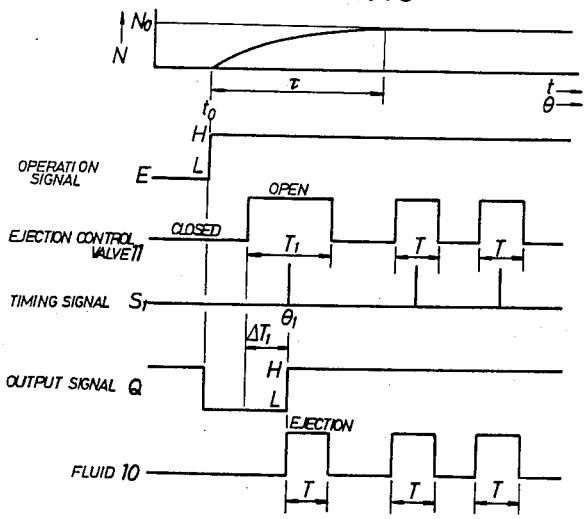
FIG. 18 is a timing chart showing operation of the control unit of the seventh embodiment.

The setting unit 96 issues a signal representative of an angle $\theta_1$ corresponding to a delay time $\Delta T_1$ to the comparator 97. When the angle $\theta_1$ is reached after the jet loom has started operating, the comparator 97 issues an "H" level timing signal $S_1$ to the AND gate 100 upon detection of coincidence between the output signal from the setting unit 96 and the signal indicative of the angle of the jet loom from the encoder 95 as shown in FIG. 18. The AND gate 100 is responsive to the "H" level timing signal $S_1$ from the comparator 97 and the operation signal E from the input terminal 87 for setting the flip-flop 98 to actuate the solenoid driver 85. The flip-flop 98 has previously been reset by the one-shot multivibrator 99 when the "H" level operation signal E is applied, as with the Embodiment 6. After the first weft inserting cycle has been finished, the control valve 12, 69 is kept open at all times and is not involved in the control of the air 66, 67 under pressure.

A circuit is added for keeping the control valve 12 open at the time the power supply is switched on. The angle $\theta_1$ corresponding to the delay time $\Delta T_1$ is set at a value optimum for the RPM of the jet loom and a weft inserting pattern. The flip-flop 98 may be reset by an "H" level operation preparation signal. The timing signal $S_1$ which is the output signal from the comparator 97 may be applied directly to the set input terminal of the flip-flop 98 without passing through the AND gate 100. The control unit 16, 72 according to the Embodiment 7 is effective in the case where the RPM of the loom increases quickly, and is simple in construction and can easily be achieved inexpensively.

Figure 19:
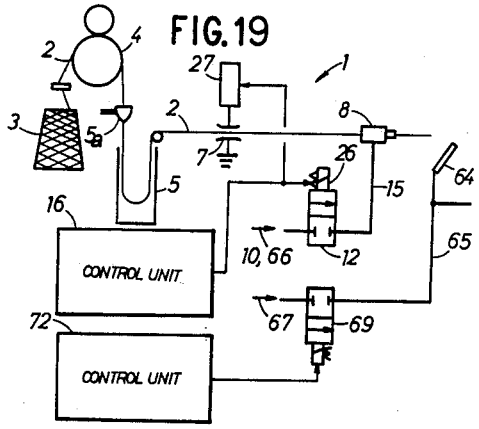
FIG. 19 is a schematic diagram of a weft inserting apparatus according to an eighth embodiment.

Embodiment 8 (FIGS. 19 through 21):

A weft inserting apparatus shown in FIG. 19 stores a weft yarn 2 after it is measured in length on an air flow, and controls air 66 under pressure with a single solenoid-operated valve 12, as with the embodiment shown in FIG. 8. The weft yarn 2 is measured by a pair of length-measuring rollers in a length-measuring unit 4 for a one-pick length necessary for being inserted through a shed, and the measured length is stored as a loop in a storage unit 5. A storage nozzle 5*a* is disposed at an inlet of the storage unit 5 for holding the stored weft yarn 2 slackened in a U shape with air. The weft yarn 2 is drawn under a weak tension by a main nozzle 8 under the control of a weft insertion control means comprising a clamp 7. The clamp 7 is actuated by a solenoid-operated actuator 27 to release the stored weft yarn 2 for being inserted by the main nozzle 8. The main nozzle 8 is supplied with air 66 under pressure through a supply passage 15 having only one control valve 12 and no ejection control valve. The control valve 12 serves to control the air 66 under pressure continuously during a transient time $\tau$ and a normal operating period. Auxiliary nozzles 64 are also supplied with air 67 under pressure through a supply passage 65 having one control valve 69 and no ejection control valve.

Figure 20:
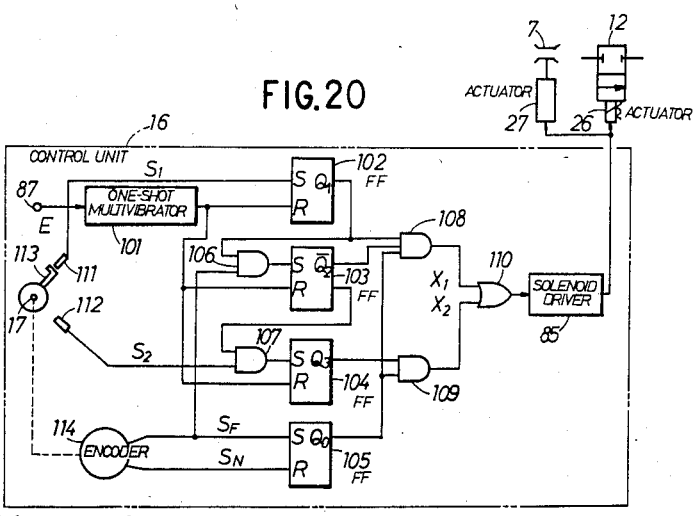
FIG. 20 is a block diagram of a control unit in the weft inserting apparatus shown in FIG. 19.

FIG. 20 shows a circuit arrangement of a control unit 16 for controlling the control valve 12 and an actuator 27 for the clamp 7. The control unit 16 comprises a one-shot multivibrator 101, RS flip-flops 102, 103, 104, 105 serving as memory circuits, AND gates 106, 107, 108, 109, an OR gate 110, and a solenoid driver 58.

The one-shot multivibrator 101 has an input terminal connected to an input terminal 87 receptive of an operation signal E and an output terminal coupled to reset input terminals of the flip-flops 102, 103, 104. The set input terminal of the flip-flop 102 and one input terminal of the AND gate 107 are connected respectively to proximity switches 111, 112 which detect a dog 113 mounted on a shaft 17 for generating timing signals $S_1$, $S_2$ at prescribed angles $\theta_1$, $\theta_2$. The flip-flop 105 has set and reset input terminals connected to the encoder 114 for detecting rotation of the shaft 17. The encoder 114 serves to detect ejection starting and ending angles $\theta_S$, $\theta_E$ of rotation of the shaft 17, and successively issues ON-timing and OFF-timing signals $S_N$, $S_F$ of a "H" level on such angle detection. The angles $\theta_S$, $\theta_E$ are adjustable in the encoder 114. The flip-flop 105 has an output terminal coupled to input terminals of the AND gates 108, 109. The flip-flop 102 has an output terminal connected to input terminals of the AND gates 106, 108. The AND gate 106 has the other input terminal connected to the encoder 114, and an output terminal coupled to a set input terminal of the flip-flop 108. The flip-flop 103 has an output terminal connected to an input terminal of the AND gate 108 and another output terminal to the other input terminal of the AND gate 107. The AND gate 107 has an output terminal connected to a set input terminal of the flip-flop 104 with its output terminal coupled to the other input terminal of AND gate 109. The AND gates 108, 109 have output terminals connected to an input terminal of the OR gate 110 having an output terminal coupled to the solenoid driver 85.

The auxiliary nozzles 64 are controlled by one control unit 72 which is of the same arrangement as that of the control unit 16. The auxiliary nozzles 64 are actuated at the same time after the weft yarn 2 has started being inserted to accelerate the weft yarn 2 while moving along the shed.

Figure 21:
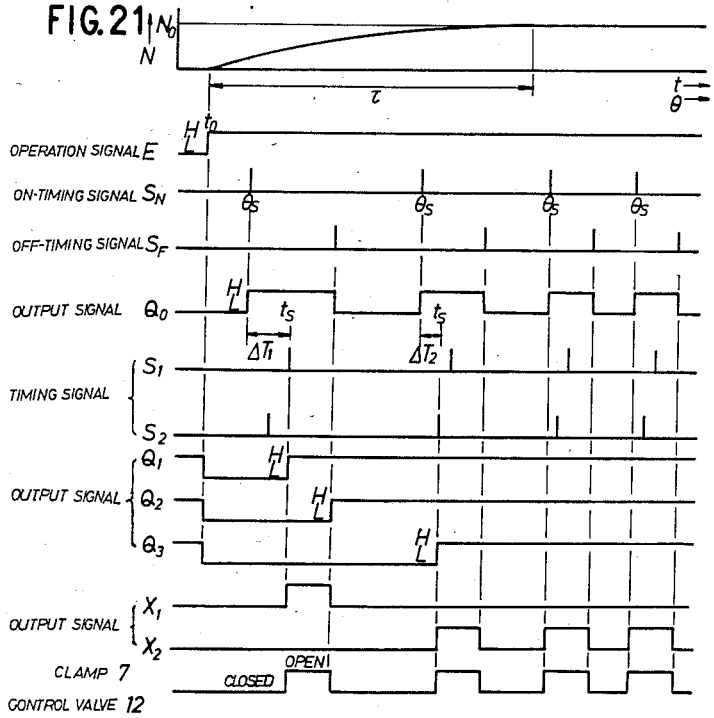
FIG. 21 is a timing chart showing operation of the weft inserting apparatus illustrated in FIG. 19.

Operation of the control unit 16 will be described with reference to FIG. 21. When an operation signal E of an "H" level is applied at an operation starting time $t_0$, the one-shot multivibrator 101 generates a "H" level output signal to reset the flip-flops 102, 103, 104, whereupon output signals $Q_1$, $Q_2$, $Q_3$ thereof go low. As an angle $\theta_S$ for starting apparent ejection is reached thereafter, the encoder 114 produces an ON-timing signal $S_N$ of a "H" level to set the flip-flop 105 for thereby rendering an output signal $Q_0$ high. When an ejection ending angle $\theta_E$ is reached, the encoder 114 produces an OFF-timing signal $S_F$ to cause the output signal $Q_0$ of the flip-flop 105 to go low. Thus, the output signal $Q_0$ from the flip-flop 105 is kept at a "H" level during an interval from the ejection starting angle $\theta_S$ to the ejection ending angle $\theta_E$. The ejection starting angle $\theta_S$ in the transient time $\tau$ does not agree with the normal ejection starting timing $t_S$. The ejection starting angle $\theta_S$ becomes equal to the normal ejection starting timing $t_S$ only after the delay time $\Delta T_1$ or the delay time $\Delta T_2$.

Since the proximity switch 111 generates the timing signal $S_1$ after the delay time $\Delta T_1$, the flip-flop 102 is set to apply the "H" level output signal $Q_1$ to one of the input terminals of each of the AND gates 106, 108. At this time, the "H" level signals are applied to all of the input terminals of the AND gate 108, which issues an "H" level output signal X1 through the OR gate 110 to the solenoid driver 85. The solenoid driver 85 now opens the control valve 12 and the clamp 7 after the delay time $T_1$ and continues to open the control valve 12 and the clamp 7 until the "H" level OFF-timing signal $S_F$ is generated. The control valve 12 therefore ejects the air 66 under pressure for a prescribed ejection time T to insert the released weft yarn 2.

The succeeding second weft inserting cycle is effected during an interval in which the output signal $Q_0$ from the flip-flop 105 is at the "H" level, and the output signal $Q_3$ from the flip-flop 104 is set at the "H" level by the timing signal $S_2$.

After the two weft inserting operations have been carried out, the transient time $\tau$ after starting the jet loom elapses, and the RPM N of the loom reaches the normal RPM $N_0$. Under the normal operating condition, the output signals $Q_1$, $Q_2$, $Q_3$ from the flip-flops 102, 103, 104 are all at the "H" level, and hence the solenoid driver 85 is actuated substantially by the ON-timing signal $S_N$ and the OFF-timing signal $S_F$. The solenoid driver 85 now opens the control valve 12 to eject the air 66 under pressure during a period from the time when the ON-timing signal $S_N$ is generated, that is, the ejection starting angle $\theta_S$ (starting timing $t_S$) to the OFF-timing signal $S_F$, that is, the ejection ending angle $\theta_E$ (ending timing $t_E$).

The foregoing controlling operation is also performed for the auxiliary nozzles 67. It is possible to control the closing of the control valve 12, that is, the timing for the weft yarn 2 to arrive at the fabric edge remote from the main nozzle 8 by shifting the timing of generation of the OFF-timing signal $S_F$. While in the foregoing embodiment the control unit 16 simultaneously controls the control valve 12 and the clamp 7, the control unit 16 may control the control valve 12 or the clamp 7 only.

Although certain preferred embodiments have been shown and described, it should be understood that many changes and modifications may be made therein without departing from the scope of the appended claims.

What is claimed is:

1. A weft inserting apparatus in a jet loom, comprising:

(a) a nozzle for inserting a stored weft yarn through a shed on a jet of fluid;

(b) weft insertion control means for controlling the starting and ending of the insertion of the weft yarn through the shed; and (c) a control unit for determining a delay time based on a rotating condition of the jet loom at least under a transient operating condition of the jet loom, and for controlling said weft insertion control means to allow the weft yarn to be inserted for a prescribed period upon elapse of said delay time after an angle for starting apparent weft insertion.

2. A weft inserting apparatus according to claim 1, wherein said weft insertion control means comprises a control valve disposed in a supply passage connected to said nozzle for controlling the time of supply of said jet of fluid.

3. A weft inserting apparatus according to claim 1, wherein said weft insertion control means comprises an engagement element for engaging the stored weft yarn for a non-insertion period and for releasing the stored weft yarn for an insertion period.

4. A weft inserting apparatus according to claim 1, wherein said weft insertion control means comprises a control valve disposed in a supply passage connected to said nozzle for controlling the time of supply of said jet of fluid, and an engagement element for engaging the stored weft yarn for a non-insertion period and for releasing the stored weft yarn for an insertion period.

5. A weft inserting apparatus according to claim 1, wherein said control unit calculates the delay time from the angle for starting apparent weft insertion based on a transient RPM, and opens said weft insertion control means during a period from a fluid ejection starting timing to a fluid ejection ending timing after said delay time during a transient time of operation of the jet loom, and opens said weft insertion control means under the normal operating condition of the loom.

6. A weft inserting apparatus according to claim 5, wherein said control unit comprises an encoder for detecting an angle of rotation of the loom and generating a signal corresponding to the detected angle, an RPM detector for calculating the RPM of the loom from said signal corresponding to the detected angle and issuing a signal indicative of the RPM, an ejection timing computing circuit for computing a delay timing from signals indicative of the RPM and normal RPM of the loom and fluid ejection starting and ending angles, a coincidence circuit for comparing the angle signal from said encoder and the delay timing and for opening said weft insertion control means upon coincidence of the angle signal and the delay timing, and a comparator for opening said weft insertion control means at all times when and after the RPM of the loom reaches the normal RPM.

7. A weft inserting apparatus according to claim 1, wherein said control unit detects an angle for starting apparent weft insertion under a transient operation condition of the loom and opens said weft insertion control means upon elapse of a delay time predetermined from said detected angle.

8. A weft inserting apparatus according to claim 7, wherein said control unit comprises detectors for detecting angles for starting apparent weft insertion and ending weft insertion, a discrimination circuit for determining how many times the weft yarn has been inserted in a transient time of the RPM of the loom, delay time setting circuits for generating signals indicative of predetermined delay times in response to an output signal from said discrimination circuit, a switching circuit for opening said weft insertion control means after said delay times, and a priority circuit for issuing a signal which causes said switching circuit to keep said weft insertion control means open.

9. A weft inserting apparatus according to claim 1, wherein said control unit calculates the delay time from the angle for starting apparent weft insertion based on a transient RPM, and opens said weft insertion control means during a period from a fluid ejection starting timing to a fluid ejection ending timing after said delay time during a transient time of operation of the jet loom, and opens said weft insertion control means for a period from a normal angle for starting weft insertion to a normal angle for ending weft insertion under the normal operating condition of the loom.

10. A weft inserting apparatus according to claim 9, wherein said control unit comprises an encoder for detecting an angle of rotation of the loom and generating a signal corresponding to the detected angle, an RPM detector for calculating the RPM of the loom from said signal corresponding to the detected angle and issuing a signal indicative of the RPM, an ejection timing computing circuit for computing a delay timing from signals indicative of the RPM and normal RPM of the loom and fluid ejection starting and ending angles, a coincidence circuit for comparing the angle signal from said encoder and the delay timing and for opening said weft insertion control means upon coincidence of the angle signal and the delay timing, and an angle comparator for opening said weft insertion control means during the period from the normal angle for starting weft insertion to the normal angle for ending weft insertion when and after the RPM of the loom reaches the normal RPM.

11. A weft inserting apparatus according to claim 1, wherein said control unit detects an angle for starting apparent weft insertion in a period of transient operation of the loom, opens said weft insertion means upon elapse of the delay time predetermined from the detected angle, and opens said weft insertion control means during a period from a normal angle for starting weft insertion to a normal angle for ending weft insertion when and after the RPM of the loom reaches the normal RPM.

12. A weft inserting apparatus according to claim 11, wherein said control unit comprises detectors for detecting angles for starting apparent weft insertion, a discrimination circuit for determining how many times the weft yarn has been inserted in a transient time of the RPM of the loom, delay time setting circuits for generating signals indicative of predetermined delay times in response to an output signal from said discrimination circuit, a switching circuit for opening said weft insertion control means after said delay times, a priority circuit for issuing a signal which causes said switching circuit to keep said weft insertion control means open, and an angle comparator for opening said weft insertion control means during the period from the normal angle for starting weft insertion to the normal angle for ending weft insertion when and after the RPM of the loom reaches the normal RPM.

13. A weft inserting apparatus according to claim 1, wherein said control unit opens said weft insertion control means for a prescribed ejection time from an angle upon elapse of the delay time after the angle for starting apparent weft insertion during transient rotation of the loom, and opens said weft insertion control means at all times during normal rotation of the loom.

14. A weft inserting apparatus according to claim 13, wherein said control unit comprises timing signal generating means for generating a timing signal corresponding to the predetermined delay time by detecting an angle upon elaplse of the delay time after the angle for starting apparent weft insertion during transient rotation of the loom, a memory circuit for storing the time of generation of said timing signal, a solenoid driver responsive to an output from said memory circuit for opening said weft insertion control means during a period from the time when the timing signal is generated to the angle at which the ejection is ended, and a memory circuit for issuing a signal to said solenoid driver for opening said weft insertion control means at all times when the RPM of the loom reaches the normal RPM.

15. A weft inserting apparatus according to claim 1, wherein said control unit opens said weft insertion control means for a prescribed ejection time from an angle upon elapse of the delay time after the angle for starting apparent weft insertion during transient rotation of the loom, and opens said weft insertion control means for a prescribed ejection time from the angle for starting weft insertion during normal rotation of the loom.

16. A weft inserting apparatus according to claim 15, wherein said control unit comprises timing signal generating means for generating a timing signal corresponding to the predetermined delay time by detecting an angle upon elapse of the delay time after the angle for starting apparent weft insertion during transient rotation of the loom, a memory circuit for storing the time of generation of said timing signal, a solenoid driver responsive to an output from said memory circuit for opening said weft insertion control means during a period from the time when the timing signal is generated to the angle at which the ejection is ended, timing signal generator means for generating ON-timing and OFF-timing signals by detecting angles for starting and ending weft insertion when and after the RPM of the loom reaches the normal RPM, and a memory circuit responsive to the ON-timing and OFF-timing signals for generating an output signal for opening said weft insertion control means during a period from an angle for starting normal weft insertion to an angle for ending normal weft insertion and for applying said output signal to said solenoid driver.

* * * * *